US006066818A

United States Patent [19]

Pan

[11] Patent Number: 6,066,818

[45] Date of Patent: May 23, 2000

[54] KEYBOARD ASSEMBLY HAVING HEAT DISSIPATING DEVICE

[75] Inventor: Hua-Tseng Pan, Taipei, Taiwan

[73] Assignee: Hon Hai Precision Ind. Co., Ltd., Taipei Hsien, Taiwan

[21] Appl. No.: 09/207,868

[22] Filed: Dec. 8, 1998

[30] Foreign Application Priority Data

Dec. 8, 1997 [TW] Taiwan ..... 86220526

[51] Int. Cl.[7] ..... H01H 13/70

[52] U.S. Cl. ..... 200/304

[58] Field of Search ..... 200/304, 344

[56] References Cited

U.S. PATENT DOCUMENTS

| | | | |
|---|---|---|---|
| 4,433,225 | 2/1984 | Cowles | 200/344 |
| 4,771,139 | 9/1988 | DeSmet | 200/304 X |
| 5,695,047 | 12/1997 | Tanahashi | 200/344 |
| 5,823,325 | 10/1998 | Lin | 200/344 |
| 5,923,530 | 7/1999 | Murayama et al. | 361/687 |
| 5,950,810 | 9/1999 | Pan et al. | 200/344 |

*Primary Examiner*—Renee S. Luebke

[57] ABSTRACT

A keyswitch for use with a keyboard, comprising an actuating mechanism, an elastic member, and a membrane switch is provided. Characterized in that at least a heat dissipating device is attached to the membrane for facilitating heat dissipation thereof.

6 Claims, 3 Drawing Sheets

KEYBOARD ASSEMBLY HAVING HEAT DISSIPATING DEVICE

FIELD OF THE INVENTION

The present invention relates to a keyboard board, and more particularly to a keyboard assembly having a heat dissipating device for facilitating quick heat dissipation within a computer housing.

DESCRIPTION OF THE PRIOR ART

In order to ensure functional operation of a computer having a powerful CPU, the heat generated from the CPU has to be efficiently removed therefrom since the CPU may malfunction if excessive heat is not dissipated. On desktop computer, a comparable larger housing is provided and the heat dissipation will not become a problem. However, on notebook computer, heat dissipation becomes a most challenge for the designer of notebook. Even compact design is always a grail for notebook designer, it is not favorable for heat dissipation.

Another concern for keyboard for notebook computer is the stroke of an individual keyswitch. Ideally, the stroke of the depressed keyswitch is preferably one half the height of an un-depressed keyswitch. This is to avoid a finger-jam between two adjacent keyswitches.

U.S. Pat. Nos. 5,386,091, 5,387,261, and 5,399,822 disclose pertinent keyswitch used for notebook computer.

SUMMARY OF THE INVENTION

An objective of the present invention is to provide a keyboard assembly having a heat dissipating device for facilitating efficient heat dissipation for notebook computer.

Another objective of the present invention is to provide a keyboard assembly having low profile to reduce height of the keyboard.

These and additional objectives, features, and advantages of the present invention will become apparent after reading the following detailed description of the preferred embodiments of the invention taken in conjunction with the appended drawing figures.

DETAILED DESCRIPTION OF PREFERRED EMBODIMENT

Figure 1:
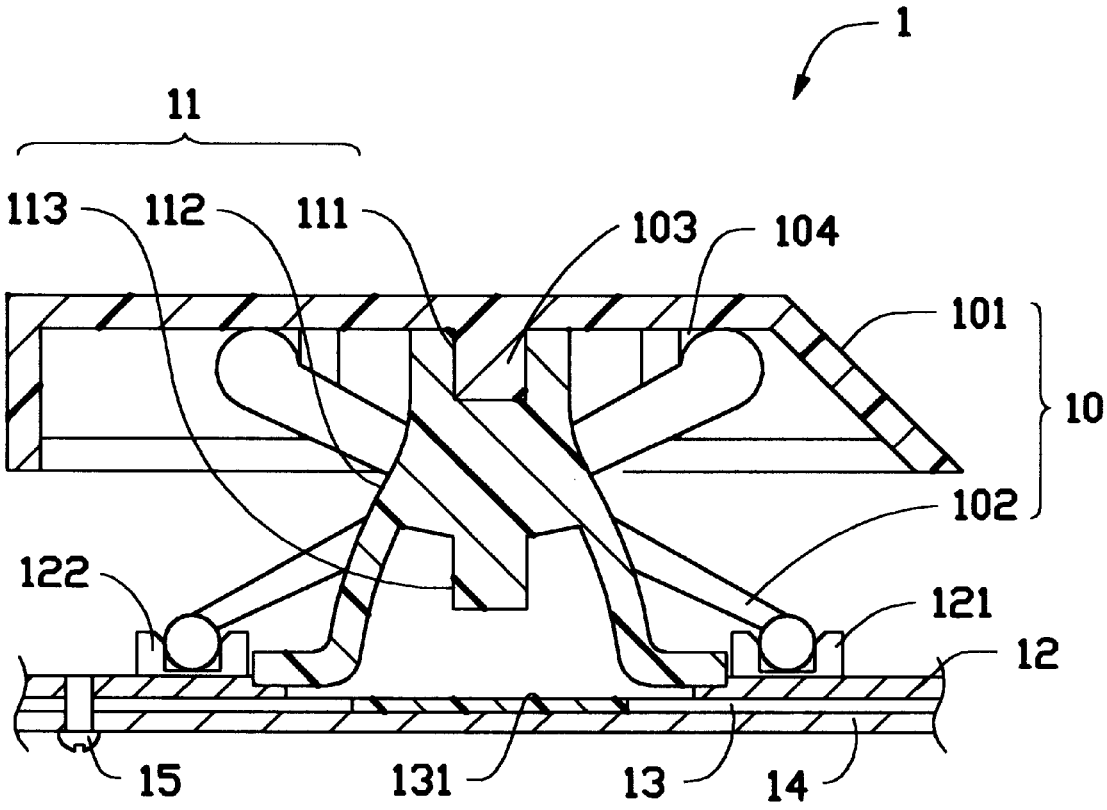
FIG. 1 is a cross sectional view of a keyboard switch in accordance with the present invention.

Referring to FIG. 1, a keyswitch 1 includes an actuating mechanism 10, an elastic member 11, a first heat dissipating plate 12, a membrane switch 13, a second heat dissipating plate 14, and a locking screw 15. The actuating mechanism 10 includes a keycap 101, and a scissors-link 102. A ceiling (not labeled) of the keycap 101 is provided with a pin shaft 103 which serves as a seat for the elastic member 11. One end of the scissors-link 102 abuts an inner wall 104 of the keycap 101 and the other end pivotally bears on the first heat dissipating plate 12. By this arrangement, the keycap 101 moves smoothly downward and upward. The elastic member 11 is made from a suitable resin material and includes a connecting boot 111, a dome portion 112, and an actuator

113. The boot 111 may engage with the pin shaft 103. A lower peripheral 112*a* of the dome portion 112 abuts on the first heat dissipating plate 12. By this arrangement, the keycap 101 is provided with an upward force. When the keycap 101 is depressed, the actuator 113 may press against the membrane switch 13 to trigger a signal.

The membrane switch 13 is sandwiched between the first and second heat dissipating plates 12, 14. The membrane switch 13 includes contacts 131 which are closed when triggered by the actuator 113. The first heat dissipating plate 12 is made from a metal sheet having a thickness of 0.3 millimeter. The first heat dissipating plate 12 includes a pair of mounting lugs 121,122 each for pivotally receiving an end of the scissors-link 102. The other end of the scissors-link 102 moveably abuts the ceiling of the keycap 1O1. The second heat dissipating plate 14 is disposed below the membrane switch 13. The second heat dissipating plate 14 is made from same material of the first dissipating plate 12 and has a thickness of 0.3 millimeters. A locking screw 15 is used to combine the second heat dissipating plate 14, the membrane switch 13, and the first heat dissipating plate 12. The locking screw 15 serves also as a heat conducting medium between the first and second heat dissipating plates 12,14. By this arrangement, heat generated from a CPU (not shown) which is close to the heat dissipating plate 14, thereto can be readily transferred to the first heat dissipating plate 12 through the second heat dissipating plate 14 and the locking bolt 15. As a result, heat generated from the CPU can be evenly distributed over the first and second heat dissipating plates 12, 14 and finally dissipate to the atmosphere.

Figure 2:
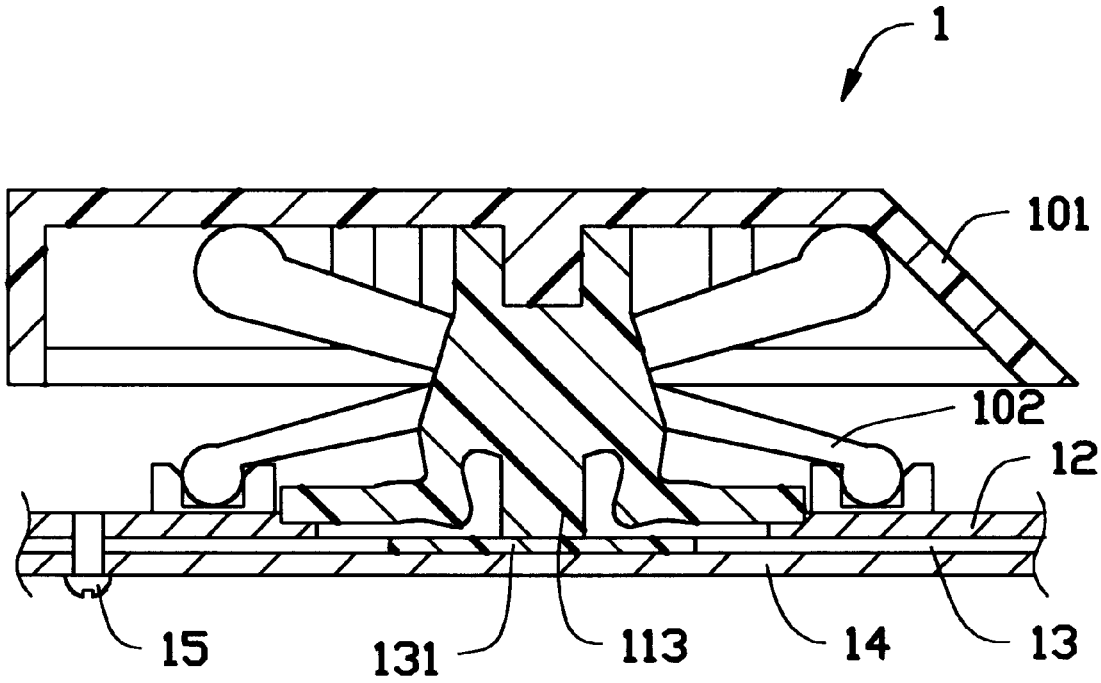
FIG. 2 is still a cross sectional view of the keyboard of FIG. 1 in which the keyswitch is depressed.

Referring to FIG. 2, when the keycap 101 is depressed, the upper end of the scissors-link 102 moves along the ceiling of the keycap 101. As a result, the keycap 101 moves smoothly downward and upward.

Figure 3:
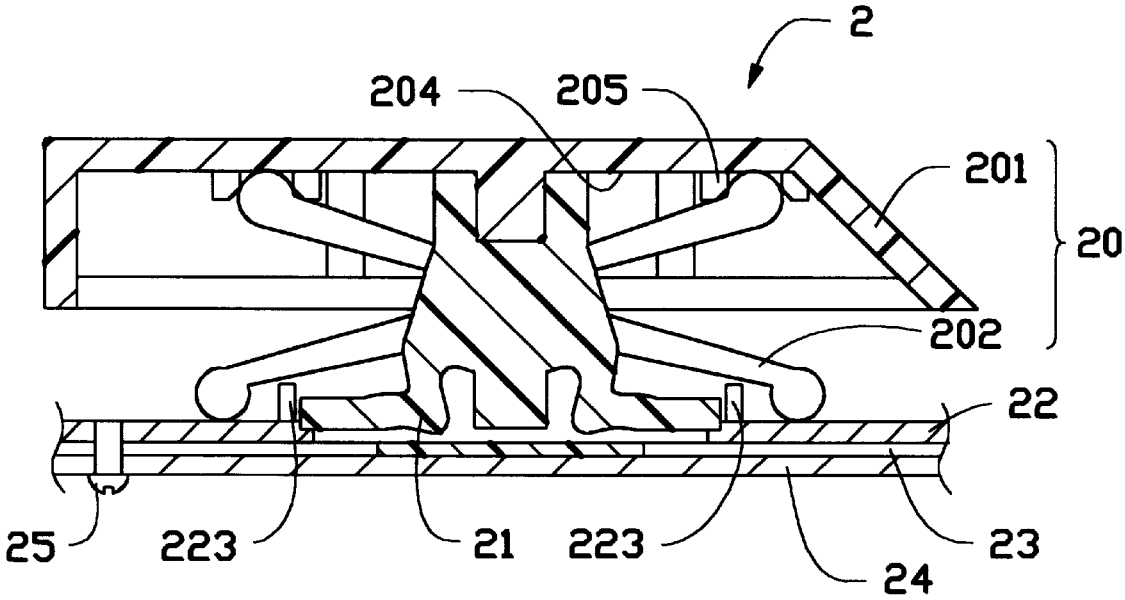
FIG. 3 is still a cross sectional view of a second embodiment in accordance with the present invention.

FIG. 3 is a second embodiment of a keyswitch 2 in accordance with the present invention. The keyswitch 2 includes an actuating mechanism 20, an elastic member 21, a first heat dissipating plate 22, a membrane switch 23, a second heat dissipating plate 24, and a locking screw 25. In this embodiment, a pair of mounting lugs 205 is integrally formed on a ceiling of a keycap 201. An end of the scissors-link 202 is pivotably received within the mounting lug 20, and another end of the scissors-link 202 move ably abuts against an upper face of the first heat dissipating plate 22. A stopper 223 is formed on the first heat dissipating plate 22 to limit an over-movement of the scissors-link 202. By this arrangement, the keycap 201 moves smoothly downward and upward. The first and second heat dissipating plates 22, 24 are connected by means of a locking screw 25.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. A keyswitch for use with a keyboard, comprising an actuating mechanism, an elastic member, and a membrane switch, characterized in that said membrane switch is sandwiched by first and second heat dissipating plates for facilitating heat dissipation thereof.

2. The keyswitch as recited in claim 1, wherein said first and second heat dissipating plates are connected by at least a locking screw.

3. The keyswitch as recited in claim 2, wherein said locking screw serves as a heat transferring device.

4. The keyswitch as recited in claim 1, wherein said elastic member includes a boot to be engaged with a pin shaft formed on a ceiling of a keycap of said actuating mechanism.

5. The keyswitch as recited in claim 1, wherein said elastic member includes a dome portion, a periphery of said dome portion abutting against a portion of said first heat dissipating plate.

6. The keyswitch as recited in claim 1, wherein said elastic member further includes an actuator.

* * * * *